US005267834A

United States Patent [19]

Dinh et al.

[11] Patent Number: 5,267,834

[45] Date of Patent: Dec. 7, 1993

[54] BUCKET FOR THE LAST STAGE OF A STEAM TURBINE

[75] Inventors: Cuong V. Dinh, Schenectady; Stephen G. Ruggles, Scotia, both of N.Y.

[73] Assignee: General Electric Company, Schenectady, N.Y.

[21] Appl. No.: 996,926

[22] Filed: Dec. 30, 1992

[51] Int. Cl.[5] ..... F01D 5/12; F01D 5/22

[52] U.S. Cl. ..... 416/223 A; 416/191; 416/193 R; 416/DIG. 2

[58] Field of Search ..... 416/191, 193 R, 223 A, 416/DIG. 2

[56] References Cited

U.S. PATENT DOCUMENTS

| | | | |
|---|---|---|---|
| 1,842,957 | 1/1932 | Bassler . | |
| 2,197,334 | 4/1940 | Bohan . | |
| 3,327,995 | 6/1967 | Blackhurst et al. | 416/193 R |
| 3,367,629 | 2/1968 | Partington . | |
| 3,572,968 | 3/1971 | Musick et al. | 416/190 |
| 4,643,645 | 2/1987 | Robbins et al. | 416/191 |
| 4,682,935 | 7/1987 | Martin | 416/223 |
| 4,695,228 | 9/1987 | Purcaru | 416/223 |
| 4,767,274 | 8/1988 | Walter | 416/193 |
| 4,878,811 | 11/1989 | Jorgensen | 416/215 |
| 4,900,230 | 2/1990 | Patel | 416/223 |
| 4,941,803 | 7/1990 | Wainauski et al. | 416/DIG. 2 |
| 5,088,894 | 2/1992 | Patel | 416/219 |
| 5,160,242 | 11/1992 | Brown | 416/193 |
| 5,203,676 | 4/1993 | Ferleger et al. | 416/223 A |

FOREIGN PATENT DOCUMENTS

| | | | |
|---|---|---|---|
| 2144600 | 3/1973 | Fed. Rep. of Germany | 416/DIG. 2 |
| 2356669 | 4/1975 | Fed. Rep. of Germany . | |
| 44-18243 | 11/1969 | Japan . | |
| 52-47103 | 4/1977 | Japan . | |
| 57-2403 | 1/1982 | Japan . | |
| 59-162301 | 9/1984 | Japan . | |
| 1449667 | 1/1989 | U.S.S.R. | 416/223 A |

*Primary Examiner*—Edward K. Look
*Assistant Examiner*—Michael S. Lee
*Attorney, Agent, or Firm*—Nixon & Vanderhye

[57] ABSTRACT

A last-stage steam turbine bucket having a profile according to Charts II–XIII, XV–XXVII and XXIX of Table I.

17 Claims, 4 Drawing Sheets

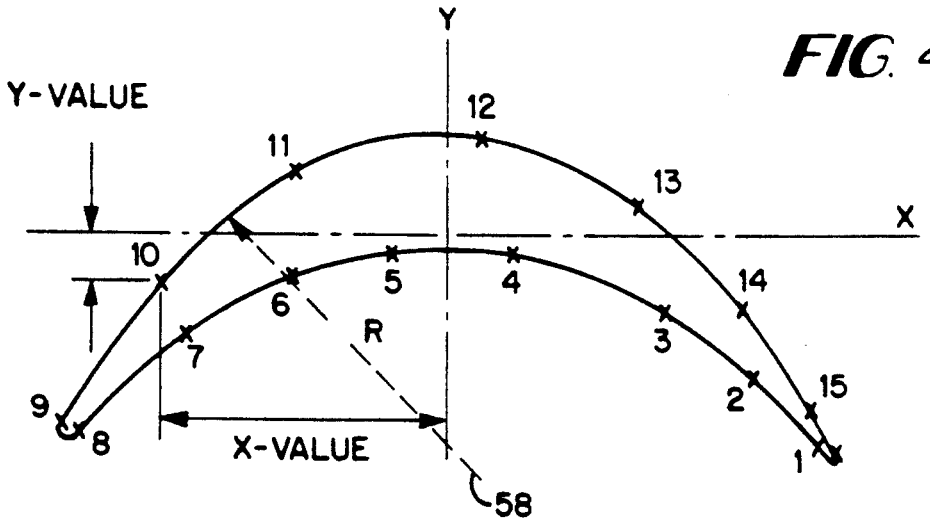
FIG. 4
FIG. 5
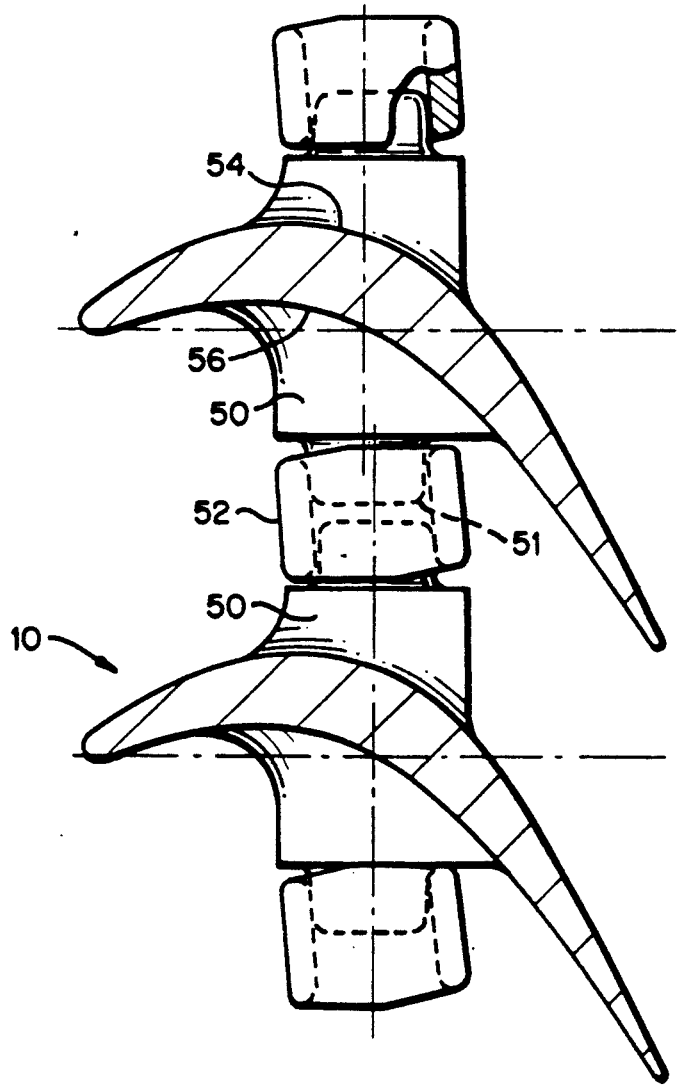

BUCKET FOR THE LAST STAGE OF A STEAM TURBINE

TECHNICAL FIELD

The present invention relates to turbines, particularly steam turbines, and particularly relates to a last-stage steam turbine bucket having improved aerodynamic efficiency and mechanical reliability.

BACKGROUND

Last-stage buckets for steam turbines have for some time been the subject of substantial developmental work. It is highly desirable to optimize the performance of these later-stage buckets to reduce aerodynamic losses, particularly when it is recognized that the last stage of a steam turbine is the highest loaded stage and contributes on the order of about 10% to the overall output of the turbine. As will be appreciated, last-stage buckets are exposed to a wide range of flows, loads and strong dynamic forces. Optimally, the bucket profile should be designed to match aerodynamically the flow of the nozzle to provide the desirable operating characteristics over a large operating range. Factors which affect the final bucket profile design include the active length of the bucket, the pitch diameter and the high operating speed in both supersonic and subsonic flow regions. Damping and bucket fatigue are factors which must be considered in the mechanical design of the bucket and its profile. The buckets must also be tuned to avoid coincidence between their natural frequencies and the flow stimuli. Additionally, the bucket profile must accommodate a smooth transition from subsonic flow adjacent the root to supersonic flow adjacent the blade tip. These mechanical and dynamic response properties of the buckets as well as others, such as thermodynamic properties or material selection all influence the optimum bucket profile. In brief, last-stage steam turbine buckets require a precisely defined bucket profile for optimal aerodynamic performance with minimum losses over a wide operating range.

Appropriate bucket profile design is also important to provide converging-diverging flow passages between adjacent buckets in the tip region and untwisting of the buckets from an ambient over-twisted configuration to a desired profile configuration at rated operation condition to achieve maximum aerodynamic efficiency. Bucket designs in the past have also included continuous coupling of the buckets at their outer tips employing covers as well as loose connections at intermediate locations along the buckets. These couplings are incorporated in the present bucket profile design to reduce bucket response to stimuli in the working fluid, which could cause uncontrolled vibration of the buckets, for example, at their natural frequencies. Vibration, of course, is to be minimized or eliminated to avoid fatigue, crack initiation and eventual structural failure and these continuous couplings, of course, affect the aerodynamic properties of the buckets. It is important also to provide a seal at the tips of the buckets to minimize aerodynamic loss resulting from flow passing around the bucket tips.

DISCLOSURE OF INVENTION

In accordance with the present invention, there is provided a bucket profile design for the last-stage bucket of a steam turbine which affords significantly enhanced aerodynamic and mechanical performance and efficiencies and reduced losses while providing for (1) transonic convergent-divergent supersonic flow passages; (2) bucket overtwist to account for untwist at operating speed to optimize efficiency; (3) covers having radial sealing ribs forming a continuous radial seal to minimize tip leakage losses; (4) minimal bucket vibration and improved bucket damping; (5) substantially improved blade incidence loss; (6) reduced section edge thickness; and (7) optimized flow distribution. Various mechanical improvements are also embodied in the present bucket profile, including a continuously coupled side entry cover design for structurally coupling and damping the buckets to minimize vibration, and an articulated nub-sleeve loose mid-bucket connection for added structural damping. The design, however, is dominated by the desired flow characteristics of the buckets for use in a particular environment and the present invention provides a particular bucket profile optimizing these objectives.

In a preferred embodiment according to the present invention, there is provided a bucket for a steam turbine having a profile in accordance with Charts II–XIII, XV–XXVII and XXIX inclusive of Table I.

In a further preferred embodiment according to the present invention, there is provided a bucket for a steam turbine having a profile in accordance with the Charts II–XIII and XVI–XXVII inclusive of Table I.

In a further preferred embodiment according to the present invention, there is provided a bucket for a steam turbine having a profile in accordance with the Charts I–XIV and XVI–XXVIII inclusive of Table I.

Accordingly, it is a primary object of the present invention to provide a novel and improved bucket for the last stage of a steam turbine having improved aerodynamic performance and mechanical reliability.

BRIEF DESCRIPTION OF DRAWINGS

FIG. 4 is a graph illustrating a representative airfoil section of the bucket profile as defined by the charts set forth in Table I of the following specification;

FIG. 5 is an enlarged cross-sectional view of connections between a pair of buckets adjacent their midpoint illustrating the material build-up for the mid-bucket connections from the theoretical desired aerodynamic profile illustrated by the full airfoil lines to the actual profile including the material build-up.

BEST MODE FOR CARRYING OUT THE INVENTION

Reference will now be made in detail to a present preferred embodiment of the invention, an example of which is illustrated in the accompanying drawings.

Figure 6:
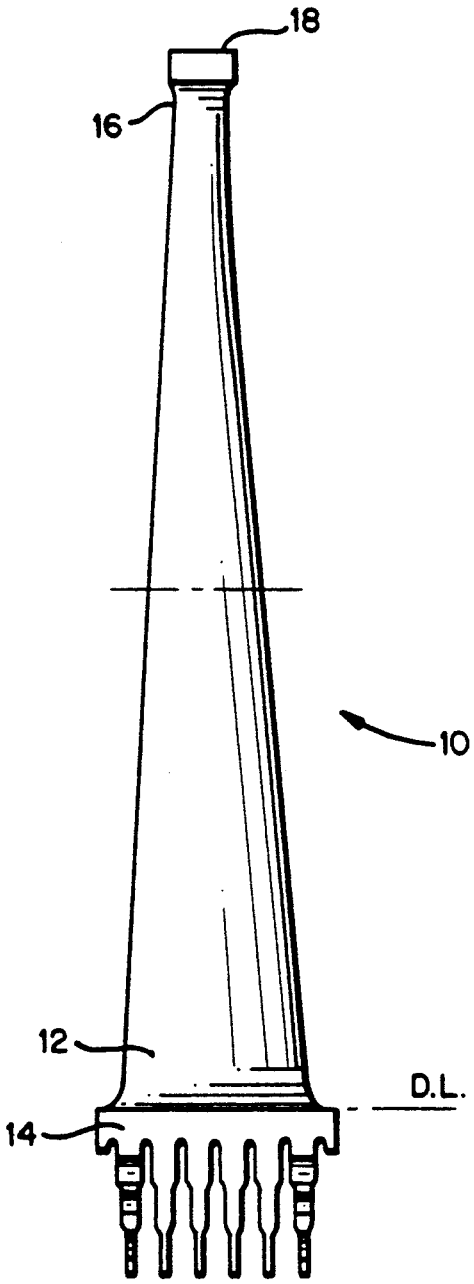
FIGS. 6 and 7 are tangential and axial views, respectively, of a bucket constructed in accordance with the present invention and illustrating its theoretical aerodynamic profile.
Figure 7:
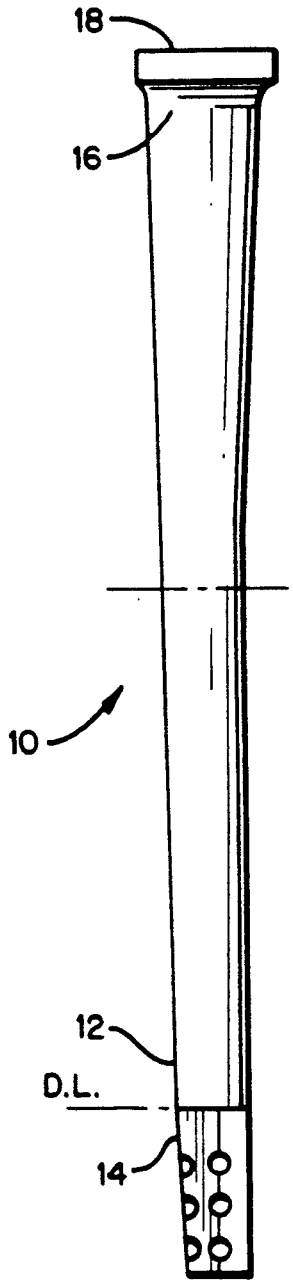

Referring to drawing FIGS. 6 and 7, the bucket of the present invention is generally designated 10 and has a root section 12 connected to a finger dovetail 14 for connection to the wheel of the turbine, not shown. Bucket 10 also includes a tip 16 having tip trapezoid 18 for connection with covers 20 FIG. 3) intermediate the tip trapezoid 18 of adjacent buckets 10, as described hereinafter. Adjacent the midpoint of each bucket, there is provided a built-up section 50, 51 for receiving a connecting sleeve 52 (FIG. 5), also as described hereinafter, for structural damping and coupling. The bucket dovetails 14, illustrated in FIGS. 6 and 7, have individual fingers 28 for connection with a turbine wheel hub, not shown.

Figure 1:
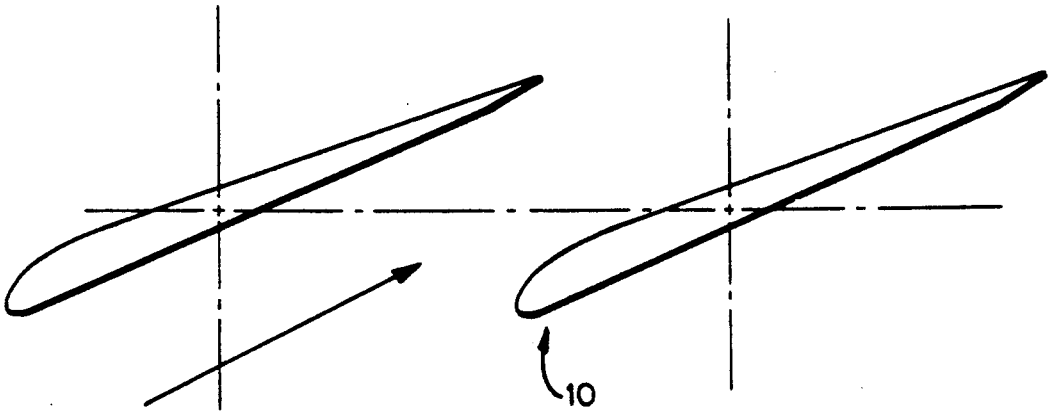
FIG. 1 is a schematic illustration of the tip sections of a pair of buckets illustrating the converging-diverging supersonic design of the buckets.
Figure 2:
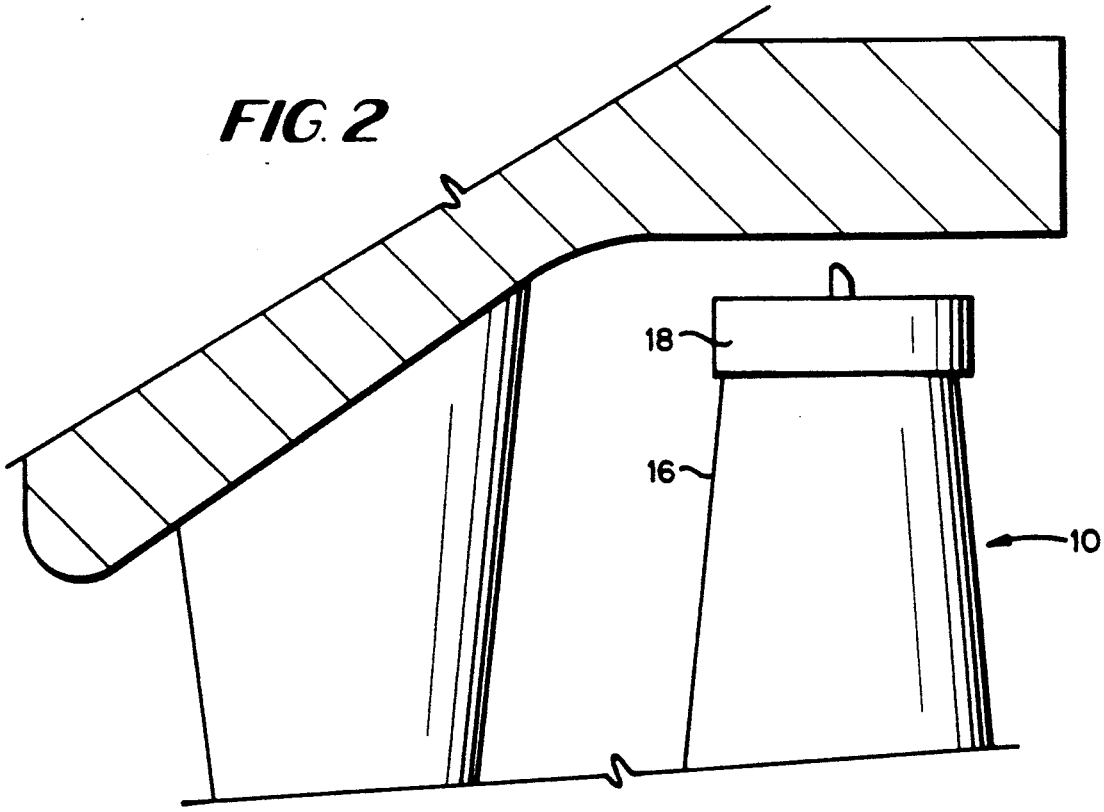
FIG. 2 is an enlarged fragmentary cross-sectional view illustrating a bucket tip and cover assembly for tip leakage control.
Figure 3:
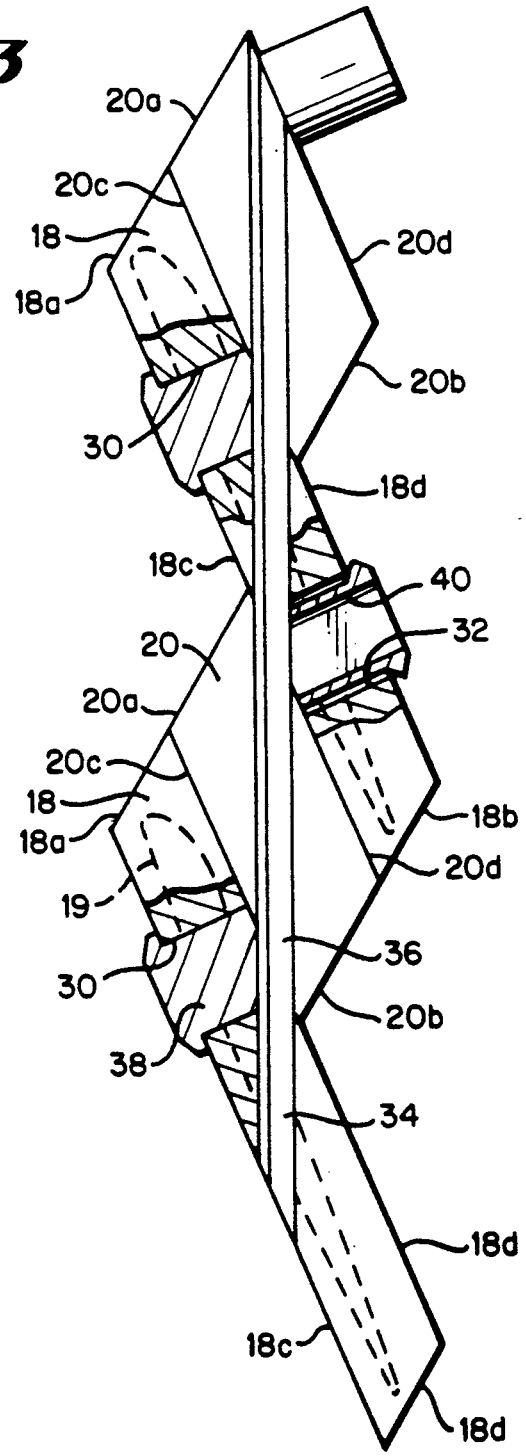
FIG. 3 is a view looking radially inwardly along a pair of adjacent buckets illustrating tip and intermediate covers with parts of the tip cover broken out and in cross-section to illustrate the cover connections.

Referring now to FIGS. 2 and 3, trapezoid 18 and intermediate covers 20 provide tip leakage control, as well as mechanical connections between adjacent blades to prevent aerodynamically excited vibrations at off design operating conditions. Trapezoid 18 and and intermediate covers 20 are coupled to one another to form a continuously coupled cover or ring about the turbine wheel at the blade tips to, among other things, reduce bucket vibration response to stimulus in the working fluid. The tip trapezoid and intermediate covers 18 and 20, respectively, in final assembly, thus form a cover band or shroud around the outer periphery of the turbine wheel to confine the working fluid within, a well-defined path and to increase the rigidity of buckets 10. More particularly, trapezoid 18 and covers 20 are alternately spaced about the periphery of the turbine wheel, with the intermediate covers 20 being side-inserted into the tip trapezoid 18, as described hereinafter.

Each tip trapezoid 18 forms an integral part of the tip of the bucket and, as viewed radially in FIG. 3, has the outline of a parallelogram. Thus, each tip trapezoid 18 has forward and rearward parallel edges 18*a* and 18*b*, respectively, and opposite side edges 18*c* and 18*d*, respectively. The blade profile adjacent the tip is illustrated by the dashed lines 19 below the tip trapezoid 18. Each tip trapezoid 18 is provided with a generally elliptical or oval-shaped bore adjacent its opposite ends, for example, bores 30 and 32. Each tip trapezoid 18 also has a radially outwardly projecting lip or tip seal section 34. The opposite ends of the tip seal section 34 terminate in angled edges parallel to the opposite side edges 18*c* and 18*d*, respectively, of the tip trapezoid 18.

As viewed looking radially inwardly as in FIG. 3, each intermediate cover 20 similarly has a profile in the form of a parallelogram. As illustrated in final assembly in FIG. 3, the long edges of each intermediate cover 20 engage forward and rearward portions of side edges 18*d* and 18*c*, respectively, of next adjacent tip trapezoid 18, filling the space therebetween. Additionally, the shorter forward and rear edges 20*a* and 20*b* of the intermediate covers 20 lie parallel to the edges of the next-adjacent tip sections 18, i.e., edges 18*a* and 18*b*, respectively, and form continuations thereof. Projecting radially outwardly from the upper surface of each tip cover 20 is a tip seal section 36, having angled end faces parallel to the edges 20*c* and 20*d* of the tip cover 20. Consequently, as seen in FIG. 3, when the tip trapezoid 18 and intermediate covers 20 are assembled on the turbine wheel buckets, the angled end faces of the tip seal sections 34 and 36, respectively, butt one another to form a continuous circumferentially extending tip seal about the periphery of the turbine wheel.

Additionally, each intermediate cover 20 carries a pair of tenons projecting from its opposite long side edges. Particularly, a solid tenon 38 projects from intermediate cover 20, e.g., from edge 20*c* and adjacent rear edge 20*b*. A hollow tenon 40 projects from its opposite edge 20*d* adjacent the forward or leading edge 20*a* of intermediate cover 20. The tenons 38 and 40 conform to the oval or elliptical shape of respective openings 30 and 32 in the tip trapezoid 18. The tenons 38 and 40 have smooth. continuous outside surfaces prior to final assembly (see the uppermost tenon 40 in FIG. 3) whereby they may be received in the respective openings 30 and 32 when the adjacent buckets are separated to permit side insertion of the intermediate covers 20 for coupling with the tip trapezoid 18. From a review of FIG. 3, it will be appreciated that the openings 32 adjacent the rearward or trailing portions of tip trapezoid 18 are slightly larger than the tenons 40.

To assemble the intermediate covers 20 to the tip trapezoid 18, adjacent buckets are spread apart to permit the covers 20 to be inserted between the buckets, enabling the solid and hollow tenons 38 and 40, respectively, to be inserted into their corresponding openings 30 and 32 in the adjacent tip trapezoid 18. Once inserted, and after the buckets have been released and returned to their normal positions, the head of the solid tenon 38 may be enlarged, e.g., by peening, to secure the tip trapezoid and intermediate covers 18 and 20, respectively, to one another. With respect to the hollow tenon 40, however, and after insertion into opening 32, its outer tip is enlarged during final assembly but in a manner enabling tenon 40 to move along its axis relative to tip trapezoid 18 and normal to its axis in the direction of the air foil of bucket 10. Succeeding intermediate covers 20 are disposed between adjacent buckets 10 about the entire periphery of the turbine wheel. With this arrangement, it will be appreciated that each pair of tip trapezoid and intermediate covers 18 and 20 are rigidly secured one to the other by the solid tenon 38, while those tip trapezoid and intermediate covers 18 and 20 secured one to the other by the hollow tenon 40 are loosely coupled one to another, enabling relative movement therebetween in two directions perpendicular to one another. Also, it will be appreciated that, in final assembly, the tip seals 34 and 36 form a continuous sealing lip about the outer periphery of the turbine wheel, minimizing leakage between the turbine wheel and the supporting stator section, as illustrated in FIG. 2.

Referring now to FIG. 5, there is illustrated the connection between adjacent buckets 10 at a location intermediate the length of the bucket, preferably about mid-bucket, for purposes of structurally damping and coupling the buckets. Adjacent the mid-point of each bucket, there is provided a bucket nub 50 projecting from each of the opposite sides thereof, each nub 50 having a coupling projection 51. A hollow sleeve 52 receives in assembly through its opposite open ends the projections 51. More particularly, on assembly, the adjacent nubs 50 are offset with each other by an amount equivalent to the dimensional untwisting of the bucket at that section at speed. A gap is specified between sleeve 52 and the projections 51 to afford a loose connection. At speed, the buckets will untwist due to centrifugal force and cause the adjacent projections 51 to line up with the sleeve 52.

In FIG. 5, the airfoil outlines of the buckets, i.e., the outlines illustrated at 54 and 56, represent the theoretically aerodynamically efficient cross-section for the bucket profile of the present invention at the radial distance from the bucket root corresponding to the location of the nubs 50. Because of structural and mechanical reasons, the mid-section of each bucket is thus built up to form the nubs 50 and projections 51 to accommodate the mid-bucket connection and afford the necessary mechanical strength to the bucket whereby the connection affords damping and coupling to minimize vibration.

Referring now to FIG. 4, there is illustrated a representative bucket section profile at a predetermined radial distance from the root section. This radial distance is taken from a datum line D.L. at the intersection of the bucket root section 12 and the finger dovetail 14 as illustrated in FIG. 6. Each profile section at that radial distance is defined in X-Y coordinates by adjacent points identified by representative numerals, for example, numerals 1 through 15, and which adjacent points are connected one to the other along the arcs of circles having radii R. For example, the arc connecting points 10 and 11 constitutes a portion of a circle having a radius R and a center at 58 as illustrated. Values of the X-Y coordinates and the radii R for each bucket section profile taken at specific radial locations or heights from the root section of the bucket are tabulated in the following charts constituting Table I. The charts identify the various points along a profile section at the given radial distance from the root section by their X-Y coordinates and it will be seen that the charts have anywhere from 14 to 44 representative X-Y coordinate points, depending upon the profile section height from the root. These values are given in inches and represent actual bucket configuration at ambient non-operating conditions (with the exception of the coordinate points noted below for the theoretical blade profile at the root, midpoint and tip of the bucket). The value for each radius R provides the length of the radius defining the arc of the circle between two of the adjacent points identified by the X-Y coordinates. The sign convention assigns a positive value to the radius R when the adjacent two points are connected in a clockwise direction and a negative value to the radius R when the adjacent two points are connected in a counterclockwise direction. By providing X-Y coordinates for spaced points about the blade profile at selected radial positions or heights from the root section and defining the radii of circles connecting adjacent points, the profile of the bucket is defined at each radial position and thus the bucket profile is defined throughout its entire length.

Chart I represents the theoretical profile of the bucket at the root. From a review of the drawing Figures, it will be appreciated that the root section has a fillet fairing the profiled bucket into the structural root or base of the bucket. The actual profile at the bucket base or root is not given but the theoretical profile of the bucket at the base or root is given in Chart I.

From a review of the charts, it will be appreciated that there are two sets of X-Y coordinates and radii R for the bucket profile at both the 13.125-inch and 26.250 inch radial distances from the root section. Chart XV marked "Nub Section" at the bottom provides the X-Y coordinates and radii R of the actual bucket profile as thickened or built-up with bucket material from the desired theoretical aerodynamic profile at that distance from the root section to form the nubs 50. At the profile 13.125 inches from the root section, the build-up is provided about one-half inch radially on opposite sides of the axis of the nubs 51. That is, the bucket profile at the 13.125-inch distance from the root section is built up for a radial distance of about one inch centered on the axis of the nubs in accordance with those coordinates and radii. The other Chart XIV at the same profile section 13.125 inches from the root section provides the desired theoretical aerodynamic profile at that radial location and without the built-up nubs 50. This theoretical aerodynamic profile is represented by the solid lines in FIG. 5. Similarly, the tips of the buckets are built up for mechanical strength reasons and to provide the tip covers. Accordingly, Chart XXIX, designated as "Tip Trapezoid Section" provides X-Y coordinates and radii R for the actual bucket profile at the tip as built up to form the tip trapezoid 18. The theoretical desirable aerodynamic profile is provided by Chart XXVIII at that same distance from the root.

It will be appreciated that having defined the profile of the bucket at various selected heights from the root, properties of the bucket such as the maximum and minimum moments of inertia, the area of the bucket at each section, the twist, torsional stiffness, sheer centers, vane width, can be ascertained.

Accordingly, Charts II–XIII, XV–XXVII and XXIX inclusive of Table I identify the actual profile of a bucket; Charts II–XIII and XVI–XXVII inclusive of Table I identify the actual and theoretical profile of a bucket at locations therealong omitting the root, the nub section and the built-up tip section; and Charts I–XIV and XVI–XXVIII inclusive of Table I identify the theoretical profile of a bucket from root to tip, all in accordance with the present invention.

TABLE I

| PT. NO. | X | Y | R |
|---|---|---|---|
| | CHART I<br>SECTION HT. FROM ROOT: 0. | | |
| 1 | 2.2841 | −1.2188 | −4.0893 |
| 2 | 1.6197 | −0.5786 | −2.8452 |
| 3 | 0.9512 | −0.1975 | −2.6016 |
| 4 | 0.0646 | −0.0108 | −2.2000 |
| 5 | −0.4561 | −0.0560 | −3.2412 |
| 6 | −0.4713 | −0.0593 | −2.8695 |
| 7 | −1.0561 | −0.2517 | −2.8670 |
| 8 | −1.5273 | −0.5217 | −3.5869 |
| 9 | −1.9919 | −0.9130 | −5.1403 |
| 10 | −2.1653 | −1.0948 | −6.0374 |
| 11 | −2.2446 | −1.1839 | 0.1344 |
| 12 | −2.2831 | −1.2144 | 0.0257 |
| 13 | −2.3205 | −1.1876 | 0.1344 |
| 14 | −2.3022 | −1.1383 | 5.4512 |
| 15 | −1.7190 | −0.3575 | 3.5263 |
| 16 | −1.0827 | 0.2001 | 2.4934 |
| 17 | −0.6672 | 0.4293 | 1.7757 |
| 18 | −0.2842 | 0.5460 | 2.7363 |
| 19 | −0.2639 | 0.5496 | 1.5500 |
| 20 | 0.2740 | 0.5501 | 2.1380 |
| 21 | 0.5926 | 0.4686 | 1.9353 |
| 22 | 0.9866 | 0.2829 | 3.0273 |
| 23 | 1.4795 | −0.0965 | 4.2660 |
| 24 | 1.9692 | −0.6489 | 3.9572 |
| 25 | 2.1254 | −0.8754 | 7.3428 |
| 26 | 2.3185 | −1.1950 | 0.0210 |
| 27 | 2.2841 | −1.2188 | 0. |
| | CHART II<br>SECTION HT. FROM ROOT: 1.313 | | |
| 1 | −2.1886 | −1.0881 | 0.0287 |
| 2 | −2.2303 | −1.0578 | 0.1695 |
| 3 | −2.2028 | −0.9908 | 3.6751 |
| 4 | −1.7671 | −0.4032 | 3.6415 |
| 5 | −0.9689 | 0.2778 | 1.8583 |
| 6 | −0.2200 | 0.5402 | 1.6190 |
| 7 | 0.4568 | 0.4720 | 2.1213 |
| 8 | 1.2017 | 0.0791 | 3.0889 |
| 9 | 1.6263 | −0.3361 | 5.2144 |

TABLE I-continued

| PT. NO. | X | Y | R |
|---|---|---|---|
| 10 | 2.2327 | −1.1950 | 0. |
| 11 | 2.2570 | −1.2375 | 0.0214 |
| 12 | 2.2219 | −1.2617 | −4.5891 |
| 13 | 1.8406 | −0.8484 | −3.2526 |
| 14 | 1.1353 | −0.3214 | −2.3785 |
| 15 | −0.1718 | −0.0037 | −2.5565 |
| 16 | −1.4801 | −0.4651 | −4.2604 |
| 17 | −2.1272 | −1.0359 | 0.1869 |
| 18 | −2.1886 | −1.0881 | 0. |
| CHART III SECTION HT. FROM ROOT: 1.969 | | | |
| 1 | −2.1416 | −1.0263 | 0.0307 |
| 2 | −2.1859 | −0.9933 | 0.1752 |
| 3 | −2.1654 | −0.9377 | 2.9658 |
| 4 | −1.9808 | −0.6560 | 3.7030 |
| 5 | −0.9803 | 0.2731 | 1.7444 |
| 6 | −0.0528 | 0.5423 | 1.6758 |
| 7 | 0.3118 | 0.4976 | 2.1465 |
| 8 | 1.2061 | 0.0462 | 3.0622 |
| 9 | 1.5301 | −0.2726 | 5.7706 |
| 10 | 2.2257 | −1.2583 | 0.0217 |
| 11 | 2.1899 | −1.2826 | −4.8800 |
| 12 | 1.7252 | −0.7826 | −3.3677 |
| 13 | 0.9818 | −0.2561 | −2.3005 |
| 14 | −0.5545 | −0.0445 | −2.4326 |
| 15 | −1.4854 | −0.4579 | −4.4529 |
| 16 | −2.0913 | −0.9885 | 0.1893 |
| 17 | −2.1416 | −1.0263 | 0. |
| CHART IV SECTION HT. FROM ROOT: 2.625 | | | |
| 1 | −2.0957 | −0.9658 | 0.0325 |
| 2 | −2.1420 | −0.9299 | 0.2164 |
| 3 | −2.1177 | −0.8667 | 2.4806 |
| 4 | −1.9399 | −0.6008 | 3.6856 |
| 5 | −0.9671 | 0.2834 | 1.6598 |
| 6 | 0.3812 | 0.4680 | 2.2071 |
| 7 | 1.0540 | 0.1370 | 2.1870 |
| 8 | 1.2852 | −0.0564 | 3.2793 |
| 9 | 1.5219 | −0.3094 | 6.2926 |
| 10 | 2.1930 | −1.2787 | 0.0219 |
| 11 | 2.1569 | −1.3031 | −5.1753 |
| 12 | 1.7151 | −0.8177 | −3.5149 |
| 13 | 0.9863 | −0.2758 | −2.2374 |
| 14 | 0.1975 | 0.0069 | −2.3252 |
| 15 | −1.4651 | −0.4326 | −4.6441 |
| 16 | −2.0431 | −0.9278 | 0.1985 |
| 17 | −2.0957 | −0.9658 | 0. |
| CHART V SECTION HT. FROM ROOT: 3.281 | | | |
| 1 | −2.0504 | −0.9069 | −0.0349 |
| 2 | −2.0995 | −0.8678 | 0.2218 |
| 3 | −2.0753 | −0.8054 | 2.1435 |
| 4 | −1.9009 | −0.5474 | 3.5858 |
| 5 | −0.9521 | 0.2943 | 1.6246 |
| 6 | 0.4002 | 0.4513 | 2.2404 |
| 7 | 1.3341 | −0.1425 | 3.7773 |
| 8 | 1.5295 | −0.3674 | 6.8993 |
| 9 | 2.1590 | −1.2985 | 0.0220 |
| 10 | 2.1225 | −1.3230 | −5.4400 |
| 11 | 1.7252 | −0.8753 | −3.7637 |
| 12 | 1.1579 | −0.4051 | −3.3023 |
| 13 | 0.8487 | −0.2201 | −2.2304 |
| 14 | −1.4333 | −0.3997 | −4.6965 |
| 15 | −1.9948 | −0.8681 | 0.2076 |
| 16 | −2.0504 | −0.9069 | 0. |
| CHART VI SECTION HT. FROM ROOT: 3.938 | | | |
| 1 | 2.0865 | −1.3423 | −5.6250 |
| 2 | 1.6205 | −0.8218 | −3.7801 |
| 3 | 1.0018 | −0.3280 | −2.1750 |
| 4 | −1.1691 | −0.2291 | −2.2861 |
| 5 | −1.4578 | −0.4068 | −4.9865 |
| 6 | −1.9506 | −0.8134 | 0.1991 |
| 7 | −2.0059 | −0.8502 | 0.0380 |
| 8 | −2.0585 | −0.8070 | 0.1991 |
| 9 | −2.0389 | −0.7554 | 1.6131 |
| 10 | −1.8729 | −0.5094 | 3.8183 |
| 11 | −1.3873 | −0.0158 | 3.2929 |

TABLE I-continued

| PT. NO. | X | Y | R |
|---|---|---|---|
| 12 | −0.9346 | 0.3058 | 1.7591 |
| 13 | −0.8976 | 0.3271 | 1.6000 |
| 14 | 0.4403 | 0.4292 | 2.1865 |
| 15 | 1.0248 | 0.1021 | 2.5725 |
| 16 | 1.4428 | −0.3100 | 7.1052 |
| 17 | 2.0024 | −1.1120 | 12.0342 |
| 18 | 2.1230 | −1.3176 | 0.0221 |
| 19 | 2.0865 | −1.3423 | 0. |
| CHART VII SECTION HT. FROM ROOT: 4.594 | | | |
| 1 | −1.9641 | −0.7957 | 0.0397 |
| 2 | −2.0177 | −0.7486 | 0.2880 |
| 3 | −1.9854 | −0.6742 | 1.7940 |
| 4 | −1.8409 | −0.4722 | 3.5630 |
| 5 | −1.0482 | 0.2383 | 2.0602 |
| 6 | −0.8353 | 0.3605 | 1.5982 |
| 7 | 0.6417 | 0.3326 | 2.4167 |
| 8 | 1.2123 | −0.0992 | 3.2637 |
| 9 | 1.4825 | −0.4131 | 7.9394 |
| 10 | 2.0317 | −1.2431 | 0. |
| 11 | 2.0850 | −1.3357 | 0.0222 |
| 12 | 2.0482 | −1.3604 | −5.5011 |
| 13 | 1.3846 | −0.6486 | −3.1473 |
| 14 | 0.8922 | −0.2861 | −2.1309 |
| 15 | −1.3906 | −0.3507 | −3.9669 |
| 16 | −1.8109 | −0.6776 | 0. |
| 17 | −1.8934 | −0.7511 | 0.2538 |
| 18 | −1.9641 | −0.7957 | 0. |
| CHART VIII SECTION HT. FROM ROOT: 5.250 | | | |
| 1 | 2.0073 | −1.3781 | −5.7796 |
| 2 | 1.2591 | −0.5806 | −2.5640 |
| 3 | 0.6433 | −0.1784 | −2.0750 |
| 4 | −1.3399 | −0.3070 | −2.3004 |
| 5 | −1.3791 | −0.3323 | −3.5294 |
| 6 | −1.5800 | −0.4755 | −3.9318 |
| 7 | −1.7848 | −0.6444 | 2.1736 |
| 8 | −1.8601 | −0.7075 | 0.2264 |
| 9 | −1.9221 | −0.7428 | 0.0433 |
| 10 | −1.9788 | −0.6902 | 0.2264 |
| 11 | −1.9598 | −0.6446 | 1.1144 |
| 12 | −1.8339 | −0.4617 | 3.9139 |
| 13 | −1.3117 | 0.0500 | 2.7129 |
| 14 | −0.8844 | 0.3345 | 1.7120 |
| 15 | −0.7901 | 0.3815 | 1.5750 |
| 16 | 0.7776 | 0.2364 | 2.8558 |
| 17 | 1.3731 | −0.3296 | 6.5191 |
| 18 | 1.8089 | −0.9560 | 15.6238 |
| 19 | 1.9263 | −1.1508 | 17.0878 |
| 20 | 2.0443 | −1.3533 | 0.0223 |
| 21 | 2.0073 | −1.3781 | 0. |
| CHART IX SECTION HT. FROM ROOT: 6.563 | | | |
| 1 | −1.8426 | −0.6355 | 0.0454 |
| 2 | −1.8987 | −0.5766 | 0.3838 |
| 3 | −1.8581 | −0.4962 | 1.2984 |
| 4 | −1.7409 | −0.3449 | 3.4039 |
| 5 | −1.0703 | 0.2290 | 2.3086 |
| 6 | −0.7642 | 0.3933 | 1.5149 |
| 7 | 0.8135 | 0.1595 | 3.1581 |
| 8 | 1.3099 | −0.3689 | 7.3071 |
| 9 | 1.7809 | −1.0872 | 0. |
| 10 | 1.9535 | −1.3876 | 0.0225 |
| 11 | 1.9162 | −1.4124 | −6.6600 |
| 12 | 1.2187 | −0.6274 | −2.5669 |
| 13 | 0.6199 | −0.1985 | −1.9808 |
| 14 | −1.2946 | −0.2503 | −2.5208 |
| 15 | −1.6183 | −0.4766 | 0. |
| 16 | −1.7520 | −0.5866 | 0.2680 |
| 17 | −1.8426 | −0.6355 | 0. |
| CHART X SECTION HT. FROM ROOT: 7.875 | | | |
| 1 | −1.7597 | −0.5244 | 0.0468 |
| 2 | −1.8146 | −0.4612 | 0.4126 |
| 3 | −1.7697 | −0.3799 | 1.3489 |
| 4 | −1.6474 | −0.2313 | 2.8240 |
| 5 | −0.8414 | 0.3595 | 1.4426 |
| 6 | 0.3131 | 0.4088 | 1.4805 |

TABLE I-continued

| PT. NO. | X | Y | R |
|---|---|---|---|
| 7 | 0.5034 | 0.3191 | 1.6245 |
| 8 | 0.8608 | 0.0473 | 3.3224 |
| 9 | 1.2257 | −0.3893 | 8.7086 |
| 10 | 1.6809 | −1.1133 | 0. |
| 11 | 1.8539 | −1.4209 | 0.0226 |
| 12 | 1.8161 | −1.4453 | −7.8066 |
| 13 | 1.1729 | −0.6780 | −2.7544 |
| 14 | 0.6471 | −0.2481 | −1.8702 |
| 15 | −0.9881 | −0.0731 | −1.9997 |
| 16 | −1.5499 | −0.3876 | 0. |
| 17 | −1.6585 | −0.4740 | 0.2716 |
| 18 | −1.7597 | −0.5244 | 0. |

CHART XI
SECTION HT. FROM ROOT: 9.188

| | | | |
|---|---|---|---|
| 1 | 1.7111 | −1.4768 | −10.5043 |
| 2 | 1.3603 | −1.0144 | −6.9412 |
| 3 | 1.0525 | −0.6569 | −2.8062 |
| 4 | 0.5915 | −0.2551 | −2.0786 |
| 5 | 0.5798 | −0.2471 | −1.7500 |
| 6 | −1.2147 | −0.1367 | −2.0943 |
| 7 | −1.4472 | −0.2770 | −1.4875 |
| 8 | −1.4962 | −0.3128 | 1.4875 |
| 9 | −1.5770 | −0.3703 | 0.2544 |
| 10 | −1.6666 | −0.4074 | 0.0486 |
| 11 | −1.7202 | −0.3390 | 0.2544 |
| 12 | −1.7075 | −0.3155 | 0.8749 |
| 13 | −1.5785 | −0.1517 | 2.6846 |
| 14 | −1.1569 | 0.1905 | 2.3232 |
| 15 | −0.7172 | 0.4157 | 1.5488 |
| 16 | −0.6787 | 0.4299 | 1.2750 |
| 17 | 0.2237 | 0.4106 | 1.6777 |
| 18 | 0.8405 | −0.0199 | 2.9294 |
| 19 | 1.1113 | −0.3689 | 11.0424 |
| 20 | 1.5755 | −1.1368 | 0. |
| 21 | 1.7494 | −1.4527 | 0.0226 |
| 22 | 1.7111 | −1.4768 | 0. |

CHART XII
SECTION HT. FROM ROOT: 10.500

| | | | |
|---|---|---|---|
| 1 | −1.5616 | −0.2826 | 0.0491 |
| 2 | −1.6114 | 0.2103 | 0.4799 |
| 3 | −1.5489 | −0.1219 | 1.4216 |
| 4 | −1.4476 | −0.0195 | 2.2393 |
| 5 | −0.7295 | 0.4219 | 1.3137 |
| 6 | −0.5936 | 0.4651 | 1.2005 |
| 7 | 0.3205 | 0.3349 | 1.8678 |
| 8 | 0.9001 | −0.2050 | 5.6895 |
| 9 | 1.1276 | −0.5598 | 20.7690 |
| 10 | 1.5035 | −1.2245 | 0. |
| 11 | 1.6434 | −1.4826 | 0.0227 |
| 12 | 1.6048 | −1.5065 | 0. |
| 13 | 1.5440 | −1.4195 | −9.6402 |
| 14 | 0.9697 | −0.6770 | −2.7129 |
| 15 | 0.4134 | −0.1829 | −1.5831 |
| 16 | −1.0351 | −0.0225 | −1.8910 |
| 17 | −1.3465 | −0.1768 | 0. |
| 18 | −1.4572 | −0.2450 | 0.2708 |
| 19 | −1.5616 | −0.2826 | 0. |

CHART XIII
SECTION HT. FROM ROOT: 11.813

| | | | |
|---|---|---|---|
| 1 | −1.4494 | −0.1466 | 0.0509 |
| 2 | −1.4953 | −0.0679 | 0.5148 |
| 3 | −1.3997 | 0.0406 | 2.3788 |
| 4 | −0.9471 | 0.3456 | 1.6179 |
| 5 | −0.6130 | 0.4740 | 1.1185 |
| 6 | 0.3504 | 0.2801 | 2.0538 |
| 7 | 0.8549 | −0.2805 | 10.7691 |
| 8 | 1.1127 | −0.7266 | 66.8934 |
| 9 | 1.5350 | −1.5116 | 0.0227 |
| 10 | 1.4962 | −1.5349 | −14.8913 |
| 11 | 0.9612 | −0.7909 | −3.2463 |
| 12 | 0.3365 | −0.1719 | −1.4179 |
| 13 | −0.9219 | 0.0534 | −2.1776 |
| 14 | −1.2418 | −0.0704 | 0. |
| 15 | −1.3413 | −0.1182 | 0.2942 |
| 16 | −1.4494 | −0.1466 | 0. |

CHART XIV
SECTION HT. FROM ROOT: 13.125

| | | | |
|---|---|---|---|
| 1 | 1.3835 | −1.5629 | −20.1064 |

TABLE I-continued

| PT. NO. | X | Y | R |
|---|---|---|---|
| 2 | 0.8979 | −0.8518 | −4.2160 |
| 3 | 0.6539 | −0.5421 | −3.6755 |
| 4 | 0.3049 | −0.1905 | −1.4240 |
| 5 | 0.0384 | −0.0051 | −1.3000 |
| 6 | −0.7383 | 0.1398 | −1.5800 |
| 7 | −0.7811 | 0.1339 | −1.9320 |
| 8 | −0.9558 | 0.0989 | −3.9599 |
| 9 | −1.2012 | 0.0294 | 1.2079 |
| 10 | −1.2597 | 0.0124 | 0.2850 |
| 11 | −1.3392 | 0.0030 | 0.0544 |
| 12 | −1.3807 | 0.0912 | 0.2850 |
| 13 | −1.3654 | 0.1089 | 0.6015 |
| 14 | −1.2534 | 0.2032 | 2.6539 |
| 15 | −0.8343 | 0.4255 | 1.3714 |
| 16 | −0.6105 | 0.4977 | 1.0500 |
| 17 | 0.3345 | 0.2488 | 1.1681 |
| 18 | 0.3670 | 0.2179 | 2.5550 |
| 19 | 0.6572 | −0.1247 | 1.8332 |
| 20 | 0.7437 | −0.2592 | 8.5588 |
| 21 | 0.9116 | −0.5612 | 42.5384 |
| 22 | 0.9849 | −0.7004 | 56.4212 |
| 23 | 1.0883 | −0.8981 | 0. |
| 24 | 1.4223 | −1.5403 | 0.0225 |
| 25 | 1.3835 | −1.5629 | 0. |

CHART XV
SECTION HT. FROM ROOT: 13.125

| | | | |
|---|---|---|---|
| 1 | −1.3392 | 0.0030 | 0.0544 |
| 2 | −1.3807 | 0.0912 | 0.2850 |
| 3 | −1.3654 | 0.1089 | 0.6015 |
| 4 | −1.2534 | 0.2032 | 2.6539 |
| 5 | −0.8343 | 0.4255 | 1.3714 |
| 6 | −0.6842 | 0.4786 | −0.3750 |
| 7 | −0.4136 | 0.8387 | 0. |
| 8 | −0.4136 | 0.8485 | 0. |
| 9 | −0.3206 | 0.8485 | −0.0620 |
| 10 | −0.2586 | 0.9105 | 0. |
| 11 | −0.2586 | 1.0485 | 0.1250 |
| 12 | −0.1336 | 1.1735 | 0. |
| 13 | 0.1864 | 1.1735 | 0.1250 |
| 14 | 0.3114 | 1.0485 | 0. |
| 15 | 0.3114 | 0.9105 | −0.0620 |
| 16 | 0.3734 | 0.8485 | 0. |
| 17 | 0.4664 | 0.8485 | 0. |
| 18 | 0.4664 | 0.2525 | −0.3750 |
| 19 | 0.5507 | 0.0156 | 2.5550 |
| 20 | 0.6572 | −0.1247 | 1.8332 |
| 21 | 0.7437 | −0.2592 | 8.5588 |
| 22 | 0.9115 | −0.5612 | 42.5384 |
| 23 | 0.9850 | −0.7004 | 56.4212 |
| 24 | 1.0883 | −0.8981 | 0. |
| 25 | 1.4223 | −1.5403 | 0.0225 |
| 26 | 1.3835 | −1.5629 | −20.1064 |
| 27 | 0.8979 | −0.8518 | −4.2160 |
| 28 | 0.7281 | −0.6301 | −0.2500 |
| 29 | 0.5348 | −0.5386 | 0. |
| 30 | 0.3274 | −0.5386 | −0.0620 |
| 31 | 0.2654 | −0.6006 | 0. |
| 32 | 0.2654 | −0.7386 | 0.1250 |
| 33 | 0.1404 | −0.8636 | 0. |
| 34 | −0.1796 | −0.8636 | 0.1250 |
| 35 | −0.3046 | −0.7386 | 0. |
| 36 | −0.3046 | −0.6006 | −0.0620 |
| 37 | −0.3666 | −0.5386 | 0. |
| 38 | −0.4596 | −0.5386 | 0. |
| 39 | −0.4596 | −0.2577 | −0.3750 |
| 40 | −0.9177 | 0.1080 | −1.9320 |
| 41 | −0.9558 | 0.0989 | −3.9599 |
| 42 | −1.2012 | 0.0294 | 1.2079 |
| 43 | −1.2597 | 0.0124 | 0.2850 |
| 44 | −1.3392 | 0.0030 | 0. |

(Nub Section)

CHART XVI
SECTION HT. FROM ROOT: 14.438

| | | | |
|---|---|---|---|
| 1 | 1.2707 | −1.5883 | 0. |
| 2 | 1.0685 | −1.2758 | −28.9608 |
| 3 | 0.7777 | −0.8342 | −4.0049 |
| 4 | 0.6640 | −0.6737 | −5.3284 |
| 5 | 0.3482 | −0.2890 | −1.5839 |
| 6 | 0.0503 | −0.0318 | −1.4000 |

TABLE I-continued

| PT. NO. | X | Y | R |
|---|---|---|---|
| 7 | −0.8176 | 0.2000 | −1.7980 |
| 8 | −0.8308 | 0.1991 | −5.1348 |
| 9 | −1.1153 | 0.1705 | 1.1142 |
| 10 | −1.1881 | 0.1635 | 0.2929 |
| 11 | −1.2390 | 0.1648 | 0.0559 |
| 12 | −1.2734 | 0.2587 | 0.2929 |
| 13 | −1.2379 | 0.2906 | 0.5843 |
| 14 | −1.1417 | 0.3502 | 2.3171 |
| 15 | −0.7699 | 0.4949 | 1.3243 |
| 16 | −0.6609 | 0.5219 | 1.0500 |
| 17 | 0.3273 | 0.1964 | 1.4225 |
| 18 | 0.3564 | 0.1631 | 2.8013 |
| 19 | 0.5760 | −0.1336 | 1.9039 |
| 20 | 0.6558 | −0.2698 | 19.1755 |
| 21 | 0.8858 | −0.7167 | 0. |
| 22 | 1.3091 | −1.5664 | 0.0221 |
| 23 | 1.2707 | −1.5883 | 0. |
| CHART XVII SECTION HT. FROM ROOT: 15.750 | | | |
| 1 | 1.1570 | −1.6137 | 0. |
| 2 | 0.9526 | −1.2737 | −15.4238 |
| 3 | 0.5084 | −0.5746 | −2.9367 |
| 4 | 0.1260 | −0.1157 | −1.4000 |
| 5 | −0.4197 | 0.2146 | −1.5415 |
| 6 | −0.4363 | 0.2199 | −1.7724 |
| 7 | −0.6804 | 0.2777 | −3.3393 |
| 8 | −1.0224 | 0.3155 | 1.8928 |
| 9 | −1.1074 | 0.3223 | 0.3058 |
| 10 | −1.1501 | 0.3299 | 0.0584 |
| 11 | −1.1727 | 0.4319 | 0.3058 |
| 12 | −1.1137 | 0.4694 | 0.5763 |
| 13 | −1.0223 | 0.5047 | 2.0406 |
| 14 | −0.6021 | 0.5801 | 1.2273 |
| 15 | −0.4964 | 0.5832 | 0.9800 |
| 16 | 0.2638 | 0.2051 | 1.1306 |
| 17 | 0.3079 | 0.1444 | 4.2893 |
| 18 | 0.5817 | −0.3208 | 14.4343 |
| 19 | 0.6594 | −0.4767 | 18.5659 |
| 20 | 0.7431 | −0.6492 | 0. |
| 21 | 1.1951 | −1.5932 | 0.0217 |
| 22 | 1.1570 | −1.6137 | 0. |
| CHART XVIII SECTION HT. FROM ROOT: 17.063 | | | |
| 1 | 1.0616 | −1.6302 | 0. |
| 2 | 1.0387 | −1.5915 | 11.6000 |
| 3 | 0.8817 | −1.3175 | −15.2834 |
| 4 | 0.5123 | −0.6931 | −9.2224 |
| 5 | 0.3197 | −0.3973 | −1.8509 |
| 6 | 0.2255 | −0.2704 | −2.0055 |
| 7 | −0.4274 | 0.2560 | −1.9000 |
| 8 | −0.7215 | 0.3749 | −2.5227 |
| 9 | −0.7272 | 0.3767 | −4.8075 |
| 10 | −0.9412 | 0.4371 | 2.4684 |
| 11 | −1.0292 | 0.4615 | 0.3084 |
| 12 | −1.0643 | 0.4743 | 0.0589 |
| 13 | −1.0699 | 0.5795 | 0.3084 |
| 14 | −1.0011 | 0.6083 | 0.5952 |
| 15 | −0.9069 | 0.6268 | 1.9789 |
| 16 | −0.5088 | 0.6315 | 1.0859 |
| 17 | −0.4928 | 0.6300 | 0.9675 |
| 18 | 0.1768 | 0.2539 | 1.1671 |
| 19 | 0.2534 | 0.1400 | 6.6418 |
| 20 | 0.5342 | −0.3887 | 28.7352 |
| 21 | 0.5856 | −0.4978 | 16.7142 |
| 22 | 0.6348 | −0.6034 | 0. |
| 23 | 1.0990 | −1.6106 | 0.0211 |
| 24 | 1.0616 | −1.6302 | 0. |
| CHART XIX SECTION HT. FROM ROOT: 18.375 | | | |
| 1 | 0.9768 | −1.6417 | 0. |
| 2 | 0.9362 | −1.5728 | 7.3500 |
| 3 | 0.7695 | −1.2739 | −18.1931 |
| 4 | 0.4927 | −0.7673 | −10.5103 |
| 5 | 0.3000 | −0.4413 | −2.6472 |
| 6 | 0.0028 | −0.0466 | −2.1380 |
| 7 | −0.3286 | 0.2489 | −2.3721 |
| 8 | −0.5627 | 0.3974 | −3.7620 |
| 9 | −0.8754 | 0.5526 | 1.3678 |

TABLE I-continued

| PT. NO. | X | Y | R |
|---|---|---|---|
| 10 | −0.9567 | 0.5916 | 0.3084 |
| 11 | −0.9850 | 0.6083 | 0.0589 |
| 12 | −0.9720 | 0.7129 | 0.3084 |
| 13 | −0.8929 | 0.7296 | 0.5226 |
| 14 | −0.8373 | 0.7310 | 1.8290 |
| 15 | −0.4004 | 0.6650 | 0.8794 |
| 16 | −0.1241 | 0.5328 | 0.8587 |
| 17 | 0.0258 | 0.3961 | 1.5681 |
| 18 | 0.1862 | 0.1738 | 2.4165 |
| 19 | 0.2774 | 0.0061 | 11.8596 |
| 20 | 0.4580 | −0.3765 | 60.6968 |
| 21 | 0.5126 | −0.4982 | 66.3418 |
| 22 | 0.5740 | −0.6358 | 0. |
| 23 | 1.0132 | −1.6231 | 0.0205 |
| CHART XX SECTION HT. FROM ROOT: 19.688 | | | |
| 1 | 0.8931 | −1.6523 | 0. |
| 2 | 0.8398 | −1.5582 | 7.2500 |
| 3 | 0.6848 | −1.2688 | −17.8841 |
| 4 | 0.2272 | −0.4093 | −3.0558 |
| 5 | 0.0512 | −0.1343 | −2.6269 |
| 6 | −0.3026 | 0.2656 | −3.8085 |
| 7 | −0.8105 | 0.6598 | 0.8193 |
| 8 | −0.8476 | 0.6854 | 0.3151 |
| 9 | −0.9013 | 0.7352 | 0.0602 |
| 10 | −0.8594 | 0.8343 | 0.3151 |
| 11 | −0.8392 | 0.8349 | 0.5634 |
| 12 | −0.7171 | 0.8215 | 1.7622 |
| 13 | −0.3656 | 0.7033 | 0.9082 |
| 14 | −0.1306 | 0.5474 | 1.1164 |
| 15 | 0.0681 | 0.3060 | 2.0822 |
| 16 | 0.1642 | 0.1302 | 8.1624 |
| 17 | 0.3287 | −0.2309 | 67.5647 |
| 18 | 0.3934 | −0.3830 | −67.5647 |
| 19 | 0.4807 | −0.5880 | 0. |
| 20 | 0.9284 | −1.6347 | 0.0198 |
| 21 | 0.8931 | −1.6523 | 0. |
| CHART XXI SECTION HT. FROM ROOT: 21.000 | | | |
| 1 | 0.8233 | −1.6641 | 0. |
| 2 | 0.7609 | −1.5511 | 6.4000 |
| 3 | 0.6063 | −1.2530 | −20.9022 |
| 4 | 0.1292 | −0.3145 | −3.1741 |
| 5 | −0.0411 | −0.0345 | −3.5121 |
| 6 | −0.3239 | 0.3275 | −5.7176 |
| 7 | −0.7361 | 0.7442 | 1.2304 |
| 8 | −0.7864 | 0.7926 | 0.3090 |
| 9 | −0.8192 | 0.8324 | 0.0590 |
| 10 | −0.7687 | 0.9250 | 0.3090 |
| 11 | −0.7114 | 0.9175 | 0.4638 |
| 12 | −0.6489 | 0.8987 | 1.5366 |
| 13 | −0.2733 | 0.6917 | -1.0053 |
| 14 | −0.0360 | 0.4387 | 1.4842 |
| 15 | 0.0653 | 0.2577 | 8.8383 |
| 16 | 0.2679 | −0.2062 | 21.4731 |
| 17 | 0.3240 | −0.3469 | −21.4731 |
| 18 | 0.4422 | −0.6399 | 0. |
| 19 | 0.8573 | −1.6478 | 0.0189 |
| 20 | 0.8233 | −1.6641 | 0. |
| CHART XXII SECTION HT. FROM ROOT: 22.313 | | | |
| 1 | 0.7663 | −1.6729 | 0. |
| 2 | 0.6896 | −1.5349 | 4.3500 |
| 3 | 0.5482 | −1.2570 | −30.8143 |
| 4 | 0.0785 | −0.2827 | −4.4567 |
| 5 | −0.0945 | 0.0284 | −5.2294 |
| 6 | −0.3347 | 0.3879 | −8.5290 |
| 7 | −0.6743 | 0.8231 | 3.3817 |
| 8 | −0.7298 | 0.8915 | 0.2843 |
| 9 | −0.7499 | 0.9204 | 0.0543 |
| 10 | −0.6981 | 1.0026 | 0.2843 |
| 11 | −0.6310 | 0.9876 | 0.5767 |
| 12 | −0.5192 | 0.9338 | 1.3589 |
| 13 | −0.2114 | 0.6714 | 1.5123 |
| 14 | 0.0202 | 0.3131 | 1.9578 |
| 15 | 0.0646 | 0.2093 | 66.4028 |
| 16 | 0.3023 | −0.4039 | −14.9154 |
| 17 | 0.3461 | −0.5174 | −40.0883 |

TABLE I-continued

| PT. NO. | X | Y | R |
|---|---|---|---|
| 18 | 0.4242 | −0.7152 | 0. |
| 19 | 0.7987 | −1.6576 | 0.0180 |
| 20 | 0.7663 | −1.6729 | 0. |
| CHART XXIII SECTION HT. FROM ROOT: 23.625 | | | |
| 1 | 0.7191 | −1.6804 | 0. |
| 2 | 0.6290 | −1.5145 | 3.5000 |
| 3 | 0.5147 | −1.2844 | 0. |
| 4 | 0.1921 | −0.5702 | −12.6832 |
| 5 | −0.2070 | 0.2240 | −8.0649 |
| 6 | −0.5742 | 0.8302 | 9.3572 |
| 7 | −0.6581 | 0.9581 | 0.2868 |
| 8 | −0.6742 | 0.9865 | 0.0548 |
| 9 | −0.6150 | 1.0646 | 0.2868 |
| 10 | −0.5265 | 1.0323 | 0.4199 |
| 11 | −0.4965 | 1.0137 | 1.0207 |
| 12 | −0.2512 | 0.7772 | 2.0532 |
| 13 | −0.0118 | 0.3574 | 1.6867 |
| 14 | 0.0169 | 0.2850 | 155.6622 |
| 15 | 0.2749 | −0.4180 | −17.1008 |
| 16 | 0.3259 | −0.5562 | −23.0078 |
| 17 | 0.3862 | −0.7157 | 0. |
| 18 | 0.7498 | −1.6664 | 0.0169 |
| 19 | 0.7191 | −1.6804 | 0. |
| CHART XXIV SECTION HT. FROM ROOT: 24.938 | | | |
| 1 | 0.6899 | −1.6834 | 0. |
| 2 | 0.5792 | −1.4823 | 1.9000 |
| 3 | 0.5067 | −1.3360 | 0. |
| 4 | 0.1422 | −0.5137 | −40.2222 |
| 5 | −0.2932 | 0.4211 | −12.2417 |
| 6 | −0.5518 | 0.9279 | 2.5377 |
| 7 | −0.5919 | 1.0054 | 0.2846 |
| 8 | −0.6052 | 1.0367 | 0.0543 |
| 9 | −0.5378 | 1.1068 | 0.2846 |
| 10 | −0.4737 | 1.0777 | 0.5386 |
| 11 | −0.3808 | 1.0057 | 0.8788 |
| 12 | −0.2289 | 0.8108 | 2.8710 |
| 13 | −0.0373 | 0.4074 | 13.8254 |
| 14 | 0.1569 | −0.1333 | −13.8254 |
| 15 | 0.2375 | −0.3665 | −65.3738 |
| 16 | 0.3137 | −0.5796 | −10.2245 |
| 17 | 0.3507 | −0.6807 | 0. |
| 18 | 0.7185 | −1.6703 | 0.0158 |
| 19 | 0.6899 | −1.6834 | 0. |
| CHART XXV SECTION HT. FROM ROOT: 25.625 | | | |
| 1 | −0.5798 | 1.0577 | 0.0537 |
| 2 | −0.5088 | 1.1225 | 0.3896 |
| 3 | −0.3518 | 1.0105 | 1.0614 |
| 4 | −0.1391 | 0.6611 | 10.3386 |
| 5 | 0.0906 | 0.0361 | 0. |
| 6 | 0.1028 | 0.0010 | −87.6278 |
| 7 | 0.6140 | −1.3979 | 0. |
| 8 | 0.7143 | −1.6689 | 0.0151 |
| 9 | 0.6869 | −1.6815 | 0. |
| 10 | 0.5703 | −1.4727 | 1.3500 |
| 11 | 0.5159 | −1.3642 | 0. |
| 12 | −0.1463 | 0.1207 | −29.7431 |
| 13 | −0.5088 | 0.9041 | 0. |
| 14 | −0.5564 | 1.0024 | 0.2427 |
| 15 | −0.5798 | 1.0577 | 0. |
| CHART XXVI SECTION HT. FROM ROOT: 25.875 | | | |
| 1 | −0.5683 | 1.0639 | 0.0539 |
| 2 | −0.4953 | 1.1281 | 0.4084 |
| 3 | −0.3519 | 1.0262 | 1.0727 |
| 4 | −0.1422 | 0.6820 | 17.6016 |
| 5 | −0.0176 | 0.3382 | −82.0839 |
| 6 | 0.4337 | −0.9160 | 0. |
| 7 | 0.7115 | −1.6688 | 0.0149 |
| 8 | 0.6845 | −1.6812 | 0. |
| 9 | 0.5649 | −1.4684 | 1.1500 |
| 10 | 0.5160 | −1.3708 | 0. |
| 11 | −0.2255 | 0.3023 | −47.5706 |
| 12 | −0.5002 | 0.9106 | 0. |
| 13 | −0.5553 | 1.0289 | 0.2301 |

TABLE I-continued

| PT. NO. | X | Y | R |
|---|---|---|---|
| 14 | −0.5683 | 1.0639 | 0. |
| CHART XXVII SECTION HT. FROM ROOT: 26.000 | | | |
| 1 | −0.5626 | 1.0674 | 0.0541 |
| 2 | −0.4886 | 1.1310 | 0.4130 |
| 3 | −0.3456 | 1.0271 | 1.0675 |
| 4 | −0.1397 | 0.6813 | 24.6623 |
| 5 | −0.0429 | 0.4090 | −79.1193 |
| 6 | 0.4184 | −0.8771 | 0. |
| 7 | 0.7101 | −1.6687 | 0.0147 |
| 8 | 0.6834 | −1.6811 | 0. |
| 9 | 0.5686 | −1.4796 | 1.0500 |
| 10 | 0.5203 | −1.3838 | 0. |
| 11 | −0.2974 | 0.4684 | −68.1410 |
| 12 | −0.4959 | 0.9138 | 0. |
| 13 | −0.5500 | 1.0321 | 0.2243 |
| 14 | −0.5626 | 1.0674 | 0. |
| CHART XXVIII SECTION HT. FROM ROOT: 26.250 | | | |
| 1 | 0.6812 | −1.6807 | 0. |
| 2 | 0.5558 | −1.4588 | 0.8500 |
| 3 | 0.5192 | −1.3863 | 0. |
| 4 | 0.1542 | −0.5658 | 119.5269 |
| 5 | −0.1411 | 0.1134 | 0. |
| 6 | −0.4814 | 0.9069 | 5.1298 |
| 7 | −0.5444 | 1.0513 | 0.1529 |
| 8 | −0.5517 | 1.0731 | 0.0552 |
| 9 | −0.4751 | 1.1367 | 0.4064 |
| 10 | −0.3415 | 1.0379 | 1.0009 |
| 11 | −0.1656 | 0.7592 | 1.1541 |
| 12 | −0.1400 | 0.6925 | 125.7458 |
| 13 | 0.1039 | −0.0128 | −13.9367 |
| 14 | 0.1770 | −0.2211 | −63.5498 |
| 15 | 0.3140 | −0.5976 | 0. |
| 16 | 0.7074 | −1.6686 | 0.0145 |
| 17 | 0.6812 | −1.6807 | 0. |
| CHART XXIX (Tip Trapezoid Section) SECTION HT. FROM ROOT: 26.250 | | | |
| 1 | −0.6676 | 1.0280 | 0. |
| 2 | −0.3830 | 1.5219 | 0. |
| 3 | 0.9225 | −1.4311 | 0. |
| 4 | 0.6379 | −1.9250 | 0. |
| 5 | −0.6676 | 1.0280 | 0. |

While the invention has been described with respect to what is presently regarded as the most practical embodiments thereof, it will be understood by those of ordinary skill in the art that various alterations and modifications may be made which nevertheless remain within the scope of the invention a defined by the claims which follow.

What is claimed is:

1. A bucket for a steam turbine having a profile in accordance with Charts II-XIII, XV-XXVII and XXIX inclusive of Table I.

2. A plurality of buckets constructed in accordance with claim 1 spaced circumferentially about an axis of a turbine wheel and having tips, and means for continuously coupling said tips one to the other about said axis.

3. The buckets according to claim 2 wherein said coupling means includes a tip trapezoid for each bucket and a cover intermediate the tip trapezoid of next adjacent bucket tips, and means for connecting the tip trapezoid and the intermediate covers one to the other.

4. A plurality of buckets according to claim 3 including a sealing rib projecting radially from each said tip trapezoid and intermediate cover forming an annular sealing ring about the tips of said buckets.

5. A bucket according to claim 4, wherein said connecting means between adjacent tip trapezoid and intermediate covers is loose, enabling relative movement between adjacent buckets.

6. A bucket according to claim 3, wherein said connecting means includes a first loose connection between each said tip trapezoid and an adjacent intermediate cover in one direction about the turbine wheel enabling relative movement between adjacent buckets and a second rigid connection between each said tip trapezoid and an adjacent intermediate cover in the opposite direction about the turbine wheel.

7. A bucket according to claim 6, wherein said first connection includes an opening in each said tip trapezoid and a tenon carried by an adjacent intermediate cover for reception in said opening, said second connection including an opening in each said tip trapezoid and a tenon carried by another next adjacent intermediate cover for reception in said second connection opening.

8. A bucket according to claim 2 including means along intermediate portions of the lengths of aid buckets for loosely coupling adjacent buckets one to another.

9. A bucket according to claim 8 wherein said coupling means includes projections on opposite sides of each bucket and a sleeve between each bucket and engageable with said projections.

10. A bucket for a steam turbine having a profile in accordance with the Charts II–XIII and XVI–XXVII inclusive of Table I.

11. A bucket according to claim 10 having a profile in accordance with Chart XV.

12. A bucket according to claim 10 having a profile in accordance with Chart XXIX.

13. A bucket according to claim 10 having a profile in accordance with Charts XV and XXIX.

14. A bucket according to claim 10 having a profile in accordance with Chart I.

15. A bucket according to claim 14 having a profile in accordance with Chart XV.

16. A bucket according to claim 14 having a profile in accordance with Chart XXIX.

17. A bucket for a steam turbine having a profile in accordance with Charts I–XIV and XVI–XXVIII inclusive of Table I.

* * * * *